United States Patent [19]

Dammann et al.

[11] Patent Number: 4,519,204

[45] Date of Patent: May 28, 1985

[54] YARN FALSE TWISTING APPARATUS

[75] Inventors: Peter Dammann; Hellmut Lorenz, both of Remscheid; Roland Maier, Radevormwald, all of Fed. Rep. of Germany

[73] Assignee: Barmag Barmer Maschinenfabrik AG, Remscheid, Fed. Rep. of Germany

[21] Appl. No.: 429,795

[22] Filed: Sep. 30, 1982

[30] Foreign Application Priority Data

Oct. 10, 1981 [DE] Fed. Rep. of Germany ..... 3140261
Oct. 14, 1981 [DE] Fed. Rep. of Germany ..... 3140856
Dec. 4, 1981 [DE] Fed. Rep. of Germany ..... 3147966

[51] Int. Cl.[3] ..... D02G 1/08

[52] U.S. Cl. ..... 57/340; 57/337; 57/339; 57/348

[58] Field of Search ..... 57/334–340, 57/348

[56] References Cited

U.S. PATENT DOCUMENTS

| | | | |
|---|---|---|---|
| 3,156,084 | 11/1964 | Van Dijk et al. | 57/340 |
| 3,373,554 | 3/1968 | Raschle | 57/340 |
| 4,339,915 | 7/1982 | Dammann et al. | 57/339 |
| 4,370,853 | 2/1983 | Bauer et al. | 57/340 |
| 4,402,179 | 9/1983 | Dammann et al. | 57/339 X |
| 4,406,116 | 9/1983 | Maier | 57/339 X |
| 4,408,449 | 10/1983 | Bauer et al. | 57/348 X |

FOREIGN PATENT DOCUMENTS

| | | | |
|---|---|---|---|
| 2121917 | 8/1972 | France . | |
| 988421 | 4/1965 | United Kingdom | 57/340 |
| 2083843 | 3/1982 | United Kingdom . | |

*Primary Examiner*—John Petrakes
*Attorney, Agent, or Firm*—Bell, Seltzer, Park & Gibson

[57] ABSTRACT

A yarn false twisting apparatus is disclosed which comprises a flexible disc mounted for rotation with a cooperating rigid disc to define a twisting zone therebetween. A pressure applying member is positioned adjacent the back face of the flexible disc for biasing the disc toward the rigid disc locally at the twisting zone so as to firmly engage the yarn passing through the twisting zone. The flexible disc comprises a hub portion disposed adjacent the center of the disc, an annular ring disposed concentrically about the hub portion and including a yarn engaging friction surface on one face thereof, and a distinct and highly flexible junction portion joining the hub portion and annular ring. The highly flexible junction portion permits the annular ring to readily flex in the lateral direction, to thereby permit the deflecting force to be minimized, while still permitting the rotating torque to be transmitted to the annular ring without significant circumferential deformation. The annular ring may also be divided into segments by radial or circumferential slots, to further reduce its resistance to the lateral deforming force of the pressure applying member, and to provide a substantially linear contact with the running yarn.

33 Claims, 25 Drawing Figures

YARN FALSE TWISTING APPARATUS

The present invention relates to a yarn false twisting apparatus of the type disclosed in commonly owned U.S. Pat. No. 4,339,915 to Dammann et al.

The above U.S. patent discloses a yarn false twisting apparatus which comprises a flexible disc mounted for rotation with a cooperating disc or roller to define a twisting zone between opposing friction surfaces thereof. A pressure applying member is mounted adjacent the back face of the flexible disc for biasing the disc toward the other member locally at the twisting zone so as to firmly engage the yarn passing through the twisting zone. The friction false twisting apparatus shown in German Pat. No. 1,192,779, which corresponds to U.S. Pat. No. 3,156,084, may be improved by the above feature, with the effect that pulsating or varying friction forces between the friction surfaces and the yarn, and which are caused by inherent imperfections in the rotating surfaces, may be avoided.

U.S. patent application Ser. No. 272,936, filed June 12, 1981, now U.S. Pat. No. 4,408,449, discloses a similar yarn false twisting apparatus wherein a flexible disc is deflected from its normal plane of rotation by its contact with the cooperating member at the twisting zone.

The use of a flexible disc in false twisting machines of the described type presents several technical problems. In particular, it is not possible to laterally flex a circular disc for linear contact of a portion thereof with a running yarn, since a lateral force will cause the outer circular edge to deflect more than the remaining portion. While a stronger biasing force might result in a more linear contact, the stronger force will also result in a higher friction force at the outer circumferential edge of the disc, which would act like a saw and damage the yarn.

Further problems associated with conventional flexible discs involve the reaction forces which are transmitted through the disc. In this regard, it appears that a lateral biasing force applied to one side of the disc results in a reaction in the opposite direction at a location offset by about 180 degrees from the point at which the biasing force is applied. When the disc is rotating, the lateral deflection migrates, and other portions are also deflected, to thereby prevent a smooth rotation.

It is accordingly an object of the present invention to provide a flexible disc adapted for use in either the above described yarn false twisting apparatus, and which achieves linear contact with a running yarn without a saw-like cutting of the yarn by the outer edge of the disc, and which avoids uncontrolled deformations and thereby achieves a smooth rotation or run.

A further object of the present invention is to provide a flexible disc adapted for use in either of the above described yarn false twisting apparatus, and which minimizes the frictional forces and wear.

In achieving the above objects in accordance with the present invention, there is provided a flexible disc which comprises a hub portion disposed adjacent the center of the disc, an annular ring disposed concentrically about the hub portion and including a yarn engaging friction surface on one face thereof, and a distinct and highly flexible junction portion joining the hub portion and annular ring and such that the annular ring is adapted to readily flex in the lateral direction with respect to the hub portion, and a rotating torque may be transmitted to the annular ring without uncontrolled circumferential deformation.

The highly flexible junction portion of the disc is thus substantially weaker than the remaining portion of the disc, and it is believed that the weaker junction portion serves to interrupt the transmission of the above described static and dynamic forces via the hub, and thereby materially contributes to the smooth rotation of the disc.

As a further aspect of the preferred embodiment of the invention, the annular ring is divided by a plurality of radial or arcuate slots, to thereby weaken the annular ring and permit it to more readily flex and linearly engage a running yarn without a sawlike cutting of the yarn by the outer edge of the disc. In addition, it is believed the weakened annular ring serves to further interrupt the transmission of the static and dynamic forces which move via the annular ring, and that the slots in the annular ring thereby further enhance the smooth rotation of the disc.

The weak distinct junction portion is also believed to contribute to the linear contact of the annular ring with the yarn. Specifically, the junction portion permits the annular ring to be deflected independently from the hub portion, and thus the lateral deflection of the hub portion is minimized upon the annular ring being deflected.

Referring to the specific embodiments of the invention as disclosed herein, the disc may be composed of an integral, relatively thin sheet of material, and the junction portion is defined by openings extending through the sheet and so as to form spokes or crosspieces positioned between the outer circumference of the hub and the inner circumference of the annular ring. These spokes are designed to permit lateral deflection of the annular ring with respect to the hub portion, and they are also able to transmit the rotating torque from the hub portion to the annular ring.

The disc may be fabricated from a unitary sheet of material by punching the openings, which may be in the form of cuts, grooves, or the like, to shape appropriate spokes. Preferably, the disc is made from a high tensile strength, spring steel sheet having a thickness of between about 0.1 to 0.5 mm.

The spokes may, for example, extend either radially or tangentially with respect to the hub portion, or they may have the shape of a double hook. In the latter case, each spoke consists of two radial segments interconnected by an intermediate arcuate segment which is concentric to the center of the disc. All of these embodiments serve the purpose of providing a flexible junction which is rigid so far as the transmission of the rotating torque from the hub to the annular ring is concerned, but is also flexible as far as the transmission of the bending force from the hub to the annular ring is concerned. It is also possible that the flexible junction may include a very thin sheet of metal or plastic foil, in combination with the formed spokes. It is then possible to weaken the junction portion to such an extent that its function is limited to the centering of the annular ring, whereas the foil provides for the transmission of the torque.

In another advantageous embodiment, the spokes are designed as parallel springs. This arrangement insures that the annular ring is deflected parallel to itself.

In another advantageous embodiment, the junction portion is characterized by cuts of equal lengths which are formed in a one piece, integral disc, with the cuts being disposed on a circle which is concentric to the hub or center of the disc. One crosspiece is left between the adjacent ends of these cuts. By this arrangement, the bending resistance between the region of the hub and the annular ring of the disc is weakened.

The cuts may also be formed on two or more concentric circles having unequal diameters, with the crosspieces between the adjacent ends of the cuts being staggered from circle to circle. If the cuts are designed, for example, in such a manner that one cut including one crosspiece covers an angle of 180 degrees, the crosspieces of adjacent circles may be staggered relative to those of the first circle by 90 degrees.

The advantage that the annular friction ring may be deflected parallel to itself may be achieved by manufacturing the disc from a pair of relatively thin and flexible circular plates, with the plates being interconnected to each other along their outer circumferences and along the circumference of a concentric circle disposed adjacent the center of the plates. In this case, the annular outer circumference of the front surface may be coated with a friction coating, or the plates may form the flexible junction between the hub and the annular ring.

Another embodiment of the flexible junction includes the formation of cuts in an integral disc, made for example of sheet steel, and in such a way that tongues are formed between the hub and annular ring. These tongues extend substantially in a circumferential direction, with one end of each tongue being joined to the hub portion and the other end of each tongue being joined to the annular ring by crosspieces. This results in an improved transmission of torque, while the bending resistance between the hub and annular ring is minimized.

A preferred feature of all embodiments is that the annular ring itself may be designed to have substantial flexibility or springiness, thereby improving its smooth run. The annular ring is thus sufficiently deformable so that it may be deflected parallel to itself and to the yarn path, and such that it is able to adapt itself to the yarn path and to the oppositely rotating friction surface. All of these measures are directed to the achievement of the object to make the annular friction ring of a flexible disc, which may be tightly fixed to a supporting shaft, independent of the area of the hub portion with respect to its bending strength, and such that the transmission of the rotating torque from the hub to the friction ring is insured, while the bending strength between the hub and annular ring is reduced to such an extent that even under a low contact pressure, the annular ring is easily and linearly pressed against the yarn.

It is also an object of the present invention to design the annular ring in such a manner that it resists only slightly the deforming force to which it is subjected during its deflection with respect to the hub portion and from its normal running plane. To achieve this object, it is preferable that the annular ring be manufactured from a spring sheet material, for example, from a sheet of spring steel, and to divide the annular ring into segments by cutting slots into the ring. These segments are connected to each other by crosspieces, and the segments form a unitary closed circle in the circumferential direction, which can be slightly twisted about its center line. This circular center line has a diameter which ranges between the largest and the smallest diameter of the annular ring. When such an easily twistable annular ring is deflected from its normal plane and relative to the hub by a contact pressure, it will tend to contact the yarn at a single point. However, since the ring has very little bending resistance, only a small contact pressure is needed to bring the ring into linear contact with the yarn.

The segments of the annular ring may be formed by radial slots which communicate with the outer circumference, so that a closed ring is left at the inner circumference of the ring. Alternatively, the slots may communicate with the inner circumference, so that a circumferentially closed ring is formed at the outer circumference of the annular ring. Radial slots may also be formed to communciate with both the inner and the outer circumference of the annular ring, so that in the center portion, i.e. in the region of the twist line of the annular ring, an annular zone remains, which is closed and continuous in the circumferential direction. The slots on the inner and outer circumferences may be radially aligned, or they may be uniformly staggered relative to each other. Radial tongues are formed by these radial slots, which are placed on an annularly closed region, and which are thereby readily flexible or bendable with respect to the closed region. As a result, the entire annular ring is easily twistable about the torsional line.

The annular ring may also be divided into separate rings by concentric slots, which are connected with each other by offset crosspieces. The annular ring thus loses the strength properties of a springy flat sheet, and its twist resistance is reduced. The separate rings may be, for example, 1 to 2 mm wide, whereas the slots or gaps between the rings may be a fraction of a millimeter.

The side of the annular ring which is in contact with the yarn is preferably coated with a friction material, such as rubber, polyurethane, or other material having the desired friction and wear properties. This friction coating may be vulcanized onto the annular ring in such a manner that the slots of the annular ring are filled, either partially or completely, which serves to dampen vibrations.

Another alternatively or additionally applicable measure for increasing the twistability of the annular ring, and for providing for a linear contact between the ring and the yarn, is to design the annular ring as a section of a convex surface, such as a spherical segment or a section of a paraboloid. The radius of the annular ring is dimensioned to insure a linear contact between the ring and yarn.

As in the known friction false twisting apparatus, the contact pressure may be exerted by a piston, roll, or the like, which resiliently contacts the back face of the disc. In such case, the friction between the annular ring and the piston should be minimized, and for this purpose, the surface of the piston may be manufactured from a material with favorable friction properties, for example graphite, or an air lubrication or liquid lubrication may be provided between the piston and the annular ring. Still further, the piston may be equipped with a roller, with which it contacts the annular ring. In accordance with the present invention, another flexible, thin disc is preferably positioned on the back face of the flexible disc, particularly in the region of the annular ring. This additional thin disc should be formed of a material having low friction properties with respect to the piston, and it should particularly prevent the piston from dry operation, so that in the event of failure of lubrication, seizing or excessive wear is avoided.

In order to increase the smoothness of the run of the flexible disc, it has been found to be advantageous that the contact pressure urging the disc against the yarn, act in front of the yarn line, when viewed in the direction of rotation of the annular ring. When the annular ring is divided into segments by slots as described above, the application of the biasing force should preferably lie on the symmetric line between the two discs. Alternatively, the yarn should run along the symmetric line, and the application of the force should be in front of such line.

To further improve the smoothness of the run of the disc, and particularly the annular ring, it is further proposed to place a substantially rigid circular plate adjacent the back side of the annular ring which contacts the yarn. The inner diameter of the annular ring is preferably covered by the outer diameter of the plate, but the circumference of the annular ring which is contacted by the piston remains uncovered. The rigid plate has been found to prevent the annular ring, when it is deflected from its normal plane, from performing a counter movement on the side which is displaced by 180 degrees relative to the pressure applying member.

The friction coating applied to the annular ring may consist of an elastic, soft material, such as a rubber compound, which prevents the annular ring from dry operation. It is also desirable to cover such a cushion-like material with a foil which has advantageous friction properties, and prevents the annular ring from dry operation. For example, the friction coating may comprise an elastically soft matrix material, in which are embedded hard particles, such as ceramic or diamond particles.

Some of the objects having been stated, other objects and advantages of the present invention will appear as the description proceeds, when taken in connection with the accompanying schematic drawings, in which -

Figure 1:
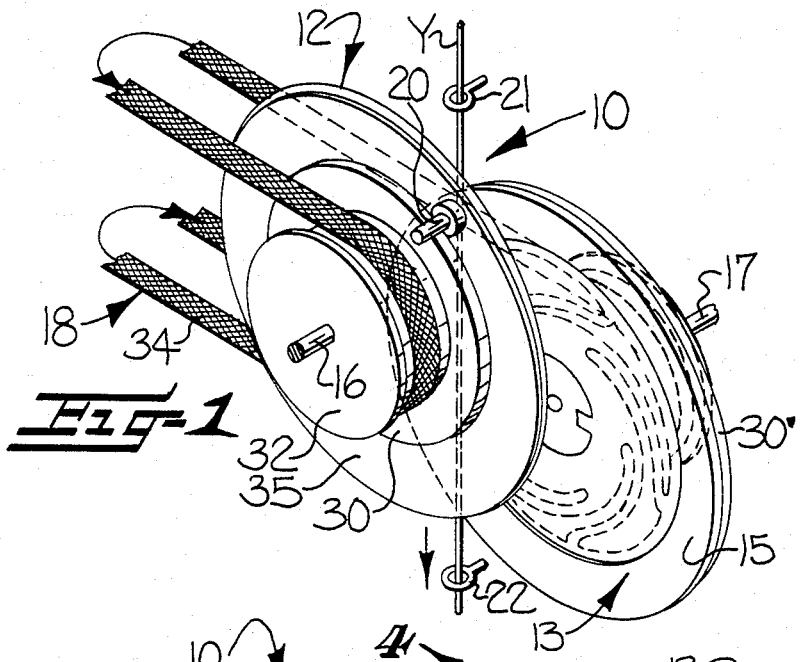
FIG. 1 is a perspective view of a yarn false twisting apparatus embodying the features of the present invention.
Figure 2:
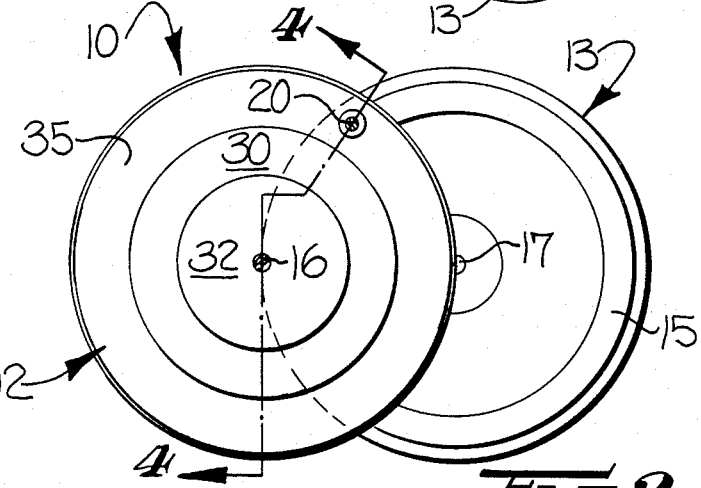
FIG. 2 is a front elevation view of the apparatus shown in FIG. 1.
Figure 3:
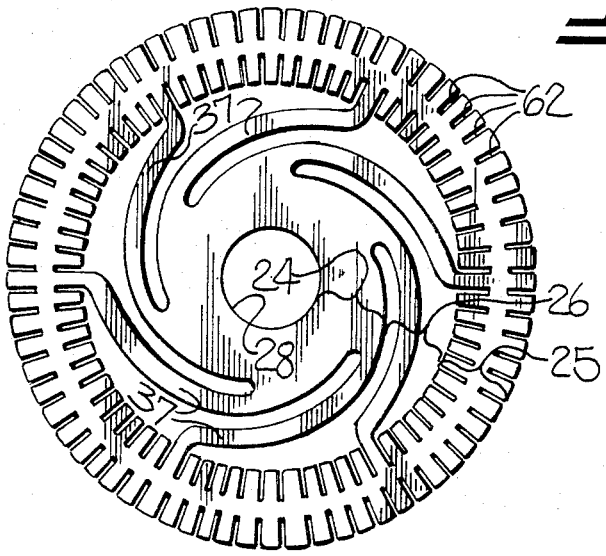
FIG. 3 is a somewhat enlarged front elevation view of one of the discs of the apparatus shown in FIG. 1, with the elastomeric coating removed for clarity of illustration.

Referring more particularly to the drawings, FIG. 1 schematically illustrates a yarn false twisting apparatus 10 which embodies the features of the present invention. More particularly, the apparatus 10 includes a pair of twist imparting circular discs 12 and 13, with each disc being of like construction and including a yarn engaging friction surface 15. The discs are rotatably mounted on the generally parallel shafts 16 and 17, respectively, and such that portions of the respective yarn engaging friction surfaces are disposed in opposing, face to face relationship and define a twisting zone therebetween. A drive belt system 18 is provided for operatively rotating each of the discs about their respective axes. In addition, a pressure applying member 20 is mounted adjacent the back face of the disc 12 for biasing such disc toward the other disc 13 locally at the twisting zone. Yarn guides 21, 22 are also provided for guiding a moving yarn through the twisting zone, and such that the moving yarn Y may have twist imparted thereto by frictional contact between the yarn and the opposed friction surfaces 15.

Figure 4:
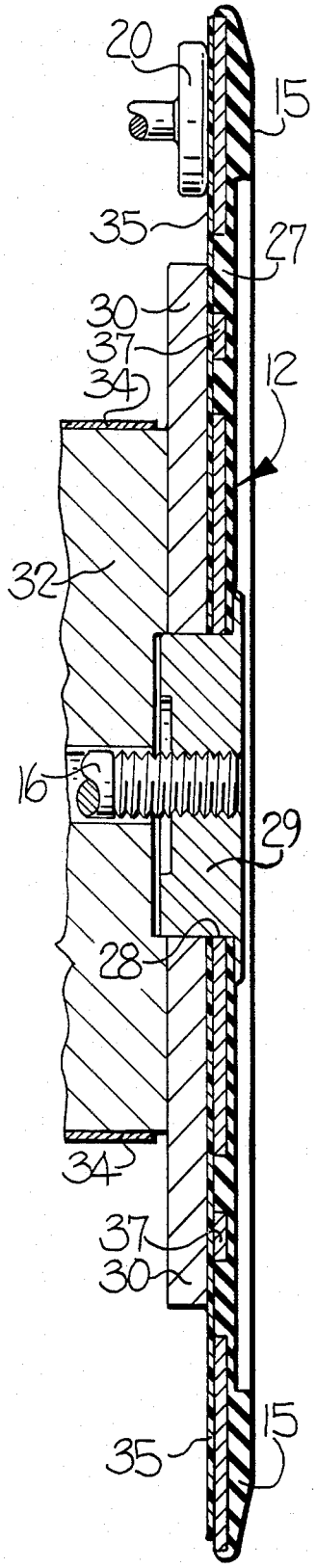
FIG. 4 is an enlarged sectional side elevation view of one disc and associated mounting structure, and which is taken substantially along the line 4—4 of FIG. 2.

In accordance with the present invention, the discs 12, 13 each comprise a hub portion 24 disposed at the center of the disc, an annular ring 25 disposed concentrically about the hub portion, and a distinct junction portion 26 joining the hub portion and the annular ring and such that the annular ring is adapted to be readily deflected in the lateral direction by the pressure applying member 20, and a rotating torque may be transmitted to the annular ring without significant circumferential deformation. Each disc is preferably composed of an integral, relatively thin sheet of metallic material, such as spring steel, having a thickness of between about 0.1 to 0.5 mm. An elastomeric material 27 may be bonded to one face of the annular ring to close the openings in the disc as hereinafter further defined, and to define the yarn engaging friction surface 15 of the disc, note FIG. 4.

In the embodiment illustrated in FIGS. 1–4, the discs 12, 13 are mounted to the shafts 16, 17 by an arrangement which includes a central opening 28 in the disc. A hub 29 is mounted at the end of the associated shaft 16 and is received in the opening 28. In the case of the disc 12, the hub 29 mounts a circular rigid backup plate 30 which has diameter somewhat less than the inner circumference of the annular ring 25. A whorl 32 is positioned adjacent the hub 29, and is engaged by the belt 34 of the drive system 18 to effect rotation of the disc. The disc 13 is similarly mounted, but the backup plate 30' has a diameter generally conforming to the outer circumference of the annular ring 25. Also, a thin flat plate 35 is interposed between the rear face of the disc 12 and the backup plate 30, with the plate 35 overlying the rear face of the annular ring 25. The plate 35 has a smooth surface and is preferably fabricated from a sheet of plastic material having a low coefficient of friction, such as Teflon, to minimize friction between the member 20 and annular ring 25. The pressure applying member 20 overlies the back face of the plate 35, and is aligned with the annular ring 25 of the disc 12 and the center of the twisting zone and yarn path. Thus the annular ring 25 of the disc 12 is deflected by the member 20 toward the ring 25 of the other disc 13 locally at the twisting zone, and the disc 13 is held rigid by the backup plate 30', and such that the two discs frictionally engage the running yarn at the twisting zone.

Figure 11:
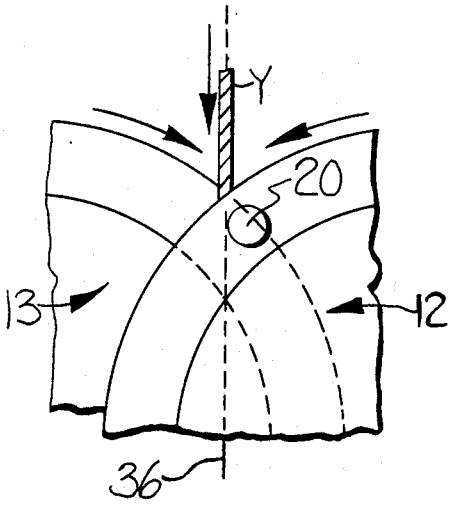
FIG. 11 is a fragmentary front elevation view of the discs of the apparatus of the present invention, and wherein the pressure applying member is positioned in front of the yarn path.
Figure 13:
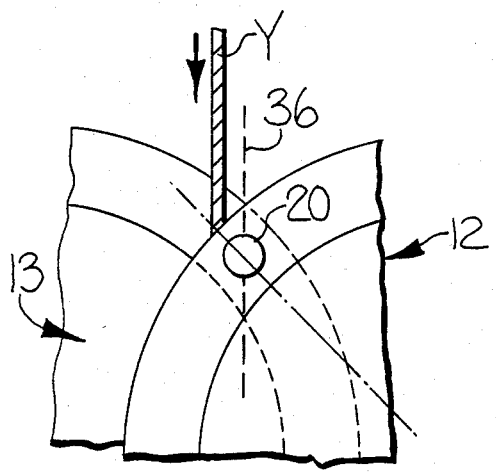
FIG. 13 is a view generally similar to FIG. 11, but illustrating a modified placement of the yarn path and pressure applying member.

FIGS. 11 and 13 show a modified embodiment wherein the pressure applying member 20 is disposed at a location which is centered in front of the center line of the yarn path of travel when viewed in the direction of rotation of the flexible disc 12. Typically, the pressure applying member is centered less than about 5 mm, and preferably about 1 mm in front of the center line of the yarn path of travel. In FIG. 11, this offset is achieved by positioning the center line of the yarn directly along the mid-point of the twisting zone, which is represented by the line 36, with the pressure applying member 20 being located to one side of both the yarn path and line 36. In FIG. 13, the pressure applying member 20 is located directly on the line 36, with the center line of the yarn path being offset behind the line 36.

As noted above, the flexible junction portion 26 is distinct from the hub portion 24 and annular ring 25. Also, this flexible portion 26 is adapted to insure that the friction surface of the annular ring 25 may be linearly pressed against the yarn, even under a small contact pressure. In addition, the portion 26 insures the transmission of the required rotational torque from the hub to the ring, without significant deformation. The several embodiments of the invention are distinguishable by the design of the junction portion 26 of the disc. For example, as illustrated in FIGS. 1–4, the disc 12 is composed of an integral, relatively thin sheet of metal, and the junction portion 26 of the disc is defined by a plurality of openings extending through the sheet. In this embodiment, the openings are shaped and define a plurality of spokes 37 extending between the hub portion and annular ring, with the spokes 37 being arcuately curved so as to lie substantially tangent to the hub portion.

Figure 9:
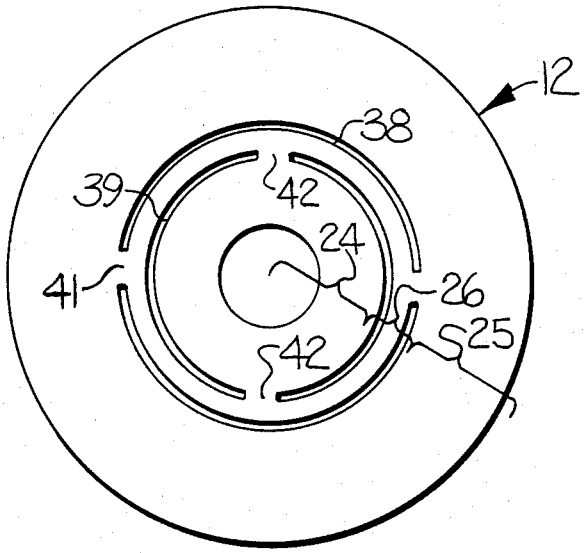

In the embodiment according to FIG. 9, the disc 12 comprises a unitary sheet of material, and the junction portion 26 is defined by two pairs of interrupted annular openings or cuts 38, 39 which define two interrupted circles which are concentric to the center of the disc and have different diameters. The interrupted circles define crosspieces 41, 42, respectively at the interruptions, and the crosspieces of one circle are circumferentially offset from the crosspieces 42 of the other circle. More particularly, the openings or cuts 38, 39 of each circle extend for slightly less than 180 degrees, to thereby define the crosspieces 41, 42, and the crosspieces of the adjacent circles are offset by 90 degrees.

Figure 10:
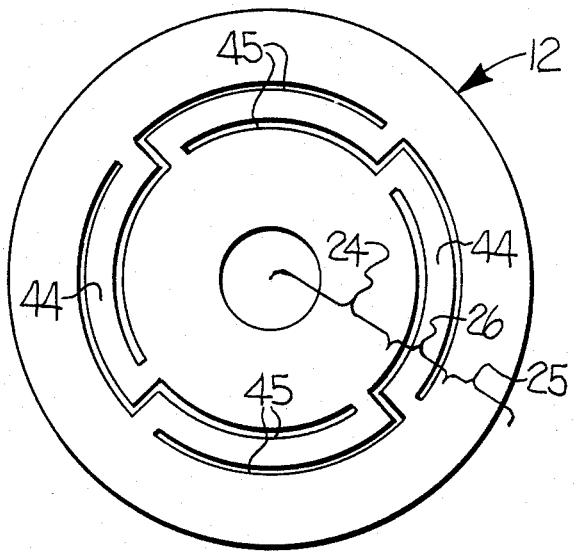

In the embodiment illustrated in FIG. 10, the junction portion 26 is defined by a plurality of spokes or tongues 44 extending in the circumferential direction, with one end of each tongue being joined to the hub portion and the other end of each tongue being joined to the annular ring. The tongues 44 are formed by hook-shaped openings or cuts 45 in the disc.

Figure 5:
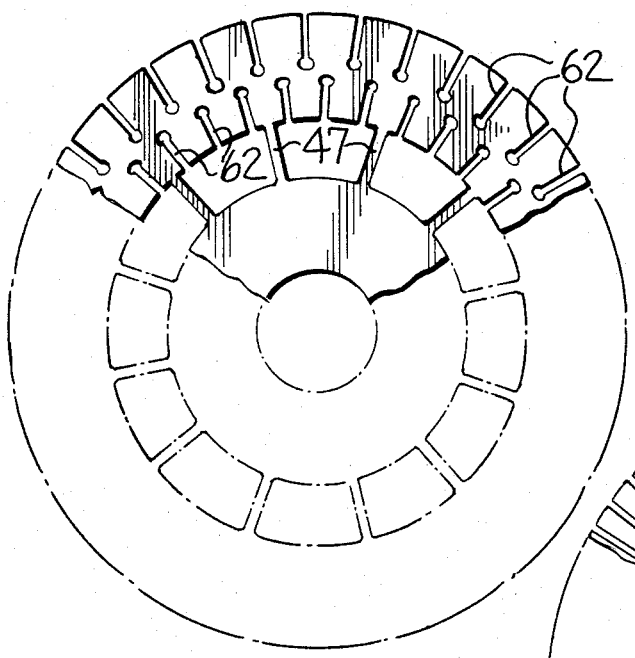
FIGS. 5–10 are front elevation views of additional embodiments of a disc in accordance with the present invention.

FIGS. 5–8 show three different embodiments of the junction portion 26, which in each case is formed by openings which define crosspieces having a length which is greater than their width and extend between the hub portion and ring. In FIG. 5, the crosspieces 47 extend radially, in FIGS. 7 and 8, the crosspieces 48 extend tangentially to the hub portion, and in FIG. 6, crosspieces 49 are hook-shaped and include a pair of radial segments **49*a* interconnected by an arcuate segment 49*b*** which is concentric to the center of the disc.

Figure 12:
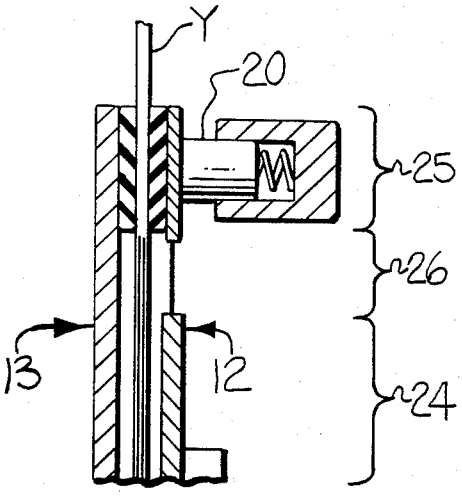
FIG. 12 is a fragmentary sectional side elevation view taken substantially along the line of the yarn path in FIG. 11.
Figure 14:
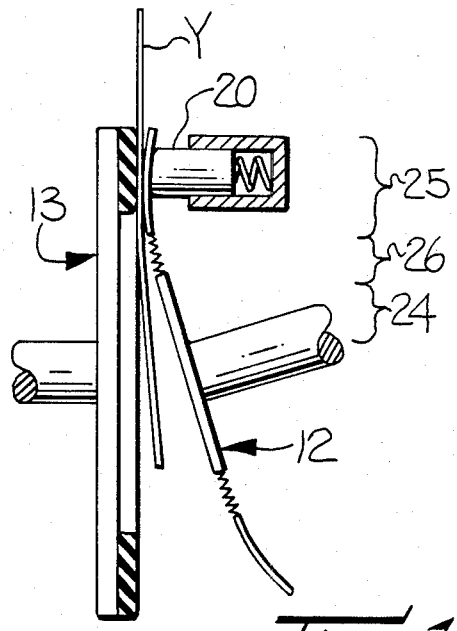
FIG. 14 is a sectional side elevation view of an embodiment wherein the annular ring of the flexible disc is arcuately curved in cross section.

Referring to FIGS. 12 and 14, the junction portion 26 may comprise a distinct thin sheet of material such as plastic or rubber, and which serves to interconnect the hub portion and annular ring.

Figure 22:
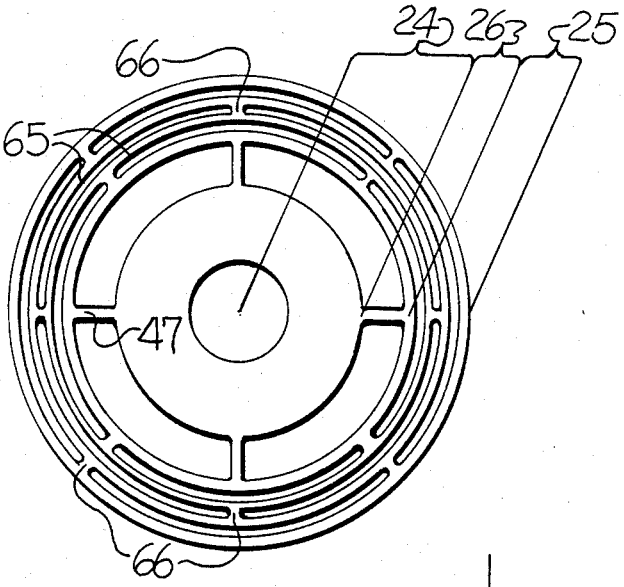
FIG. 22 is a front elevation view of a disc having arcuate slots in the annular ring.

In the embodiment of FIG. 22, the junction portion 26 is formed by radial crosspieces or spokes 47, and to provide the necessary flexibility, only four small spokes are needed, which have a ratio of length to width of about 5 to 1.

It should be noted that the junction portion 26 may take still other forms. For example, the disc may comprise a hub portion and annular ring which are connected to each other by any distinct flexible means, such as a thin sheet material, rubber disc or the like. As still another example, the annular ring may be connected to the hub portion by a flexible thin sheet, membrane or the like and additionally, by spokes. In such embodiment, the foil, membrane or the like, which preferably is adhered or vulcanized, serves both as a means for transmitting the torque, as well as a flexible connection, wherein the spokes serve to center the annular ring with respect to the hub. It should be mentioned that the sheets used for this application may consist both of metallic and of non-metallic materials, such as plastics having spring properties.

Figure 15:
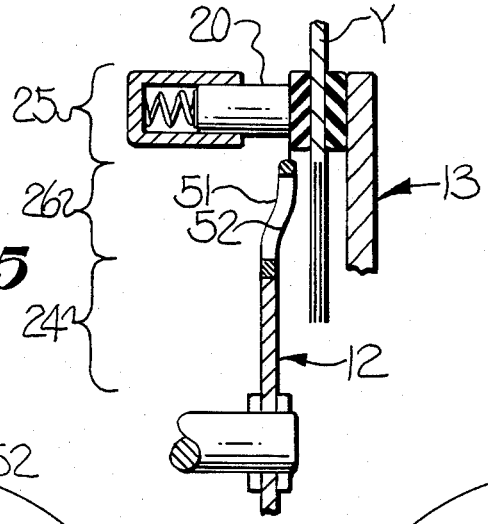
FIG. 15 is a schematic sectional view of an embodiment wherein the junction portion of the disc comprises a parallel spring.
Figure 16:
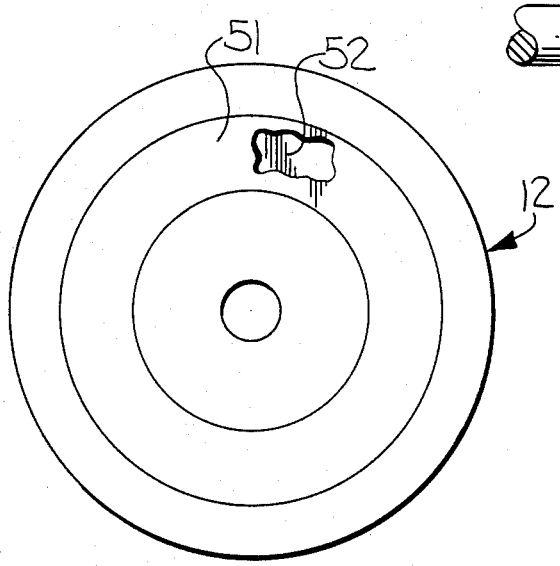
FIG. 16 is a front elevation view of the embodiment of FIG. 15, and wherein the parallel spring comprises a continuous annular band.
Figure 17:
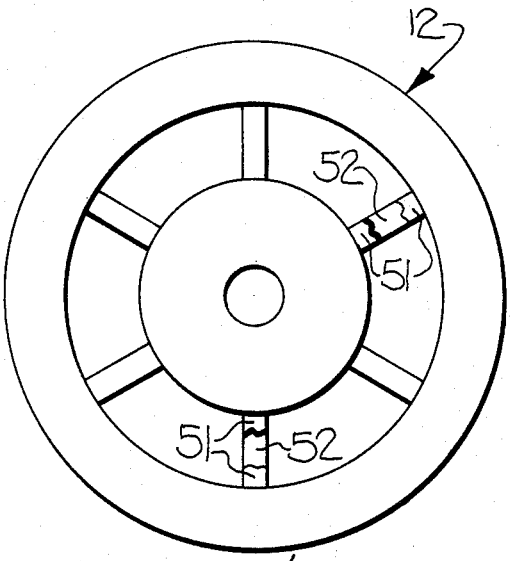
FIG. 17 is a front elevation view of the embodiment of FIG. 15, and wherein the parallel spring comprises radial crosspieces.

FIGS. 15–17 illustrate embodiments of the invention in which the deflection of the annular ring is achieved by the fact that the ring is connected to the hub portion by two parallel members 51, 52 which are spaced apart and aligned with each other in the lateral direction. The members are interconnected with each other at their ends, so as to form a parallel spring. In the embodiment of FIG. 17, the parallel members 51, 52 are in the form of a plurality of separate, radially directed crosspieces, whereas in FIG. 16, the parallel members are in the form of continuous annular bands.

Figure 18:
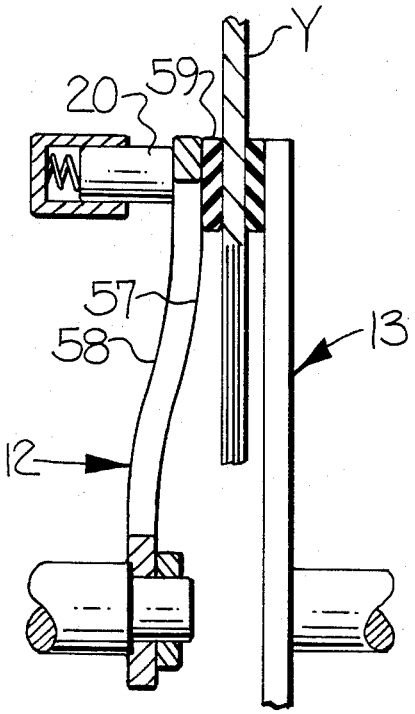
FIG. 18 is a sectional side elevation view of an embodiment wherein the flexible disc is composed of parallel plates which form a parallel spring.

In the embodiment of FIG. 18, the disc comprises a pair of relatively thin and flexible circular plates 57, 58 which are spaced apart and aligned with respect to each other in the lateral direction, with the plates being interconnected to each other along their outer circumferences and along the circumference of a concentric circle disposed adjacent the center of the plates. The remaining portions of the plates are free of any interconnection, to thereby form a parallel spring which is readily flexible in the lateral direction. The outer periphery of one face of the disc is covered by an elastomeric friction material 59 for frictionally engaging the yarn.

As noted above, the pressure applying member 20 acts to axially deflect the annular ring 25 from its normal plane. As a result of this axial deflection, the ring may be geometrically deformed. This deformation renders it more difficult to deflect the ring, and in particular, for the ring to be linearly pressed against the yarn in the twisting zone. For this reason, it is another object of the invention to maintain the forces necessary to deflect the ring as low as possible, and so that the deflection can be achieved under a low contact pressure exerted by the pressure applying member. The required deflection force can be considerably diminished by designing the disc, and particularly the annular ring 25 according to the embodiments shown in FIGS. 1–8 and 22. In each case, the annular ring 25 is divided by a series of slots to form flexibly connected segments. In the embodiments according to FIGS. 1–8, the annular ring is divided by radial slots 62, which may communicate with either the outer circumference, or the inner circumference. The degree of rigidity of the ring is dependent upon the length of, or distance between these slots. The slots may be staggered relative to each other in a circumferential direction. In each case, however, there is an annular zone remaining in the ring, which connects the segments with each other, and which insures the rigidity of the annular ring in a circumferential direction. The subdivision of the annular ring into segments also insures that each segment is readily flexible with respect to the annular zone. Thus, the annular ring as a whole is able to transmit the required rotational torque.

Figure 6:
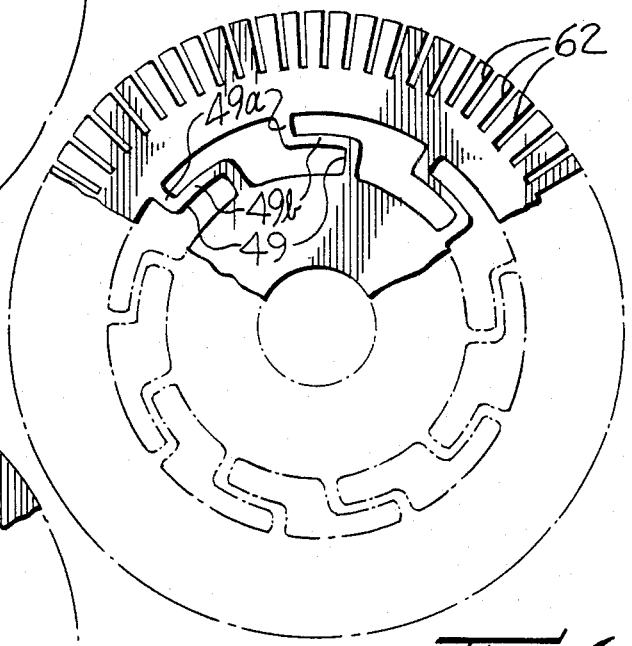
Figure 8:
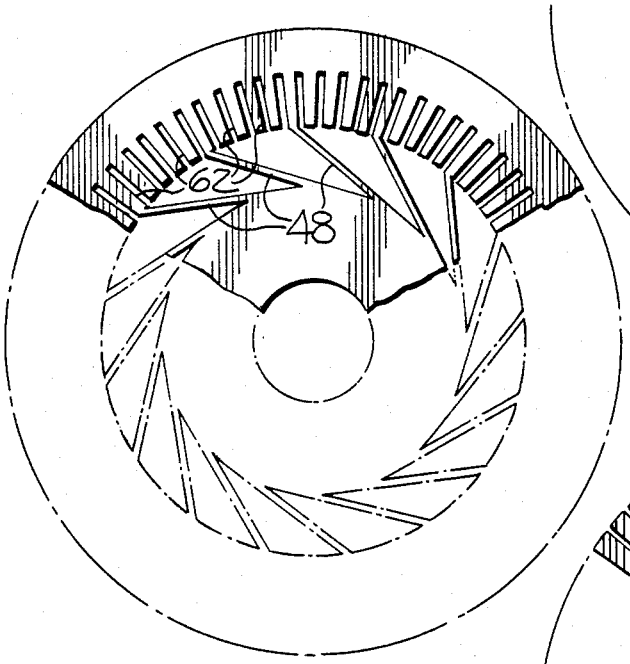
Figure 7:
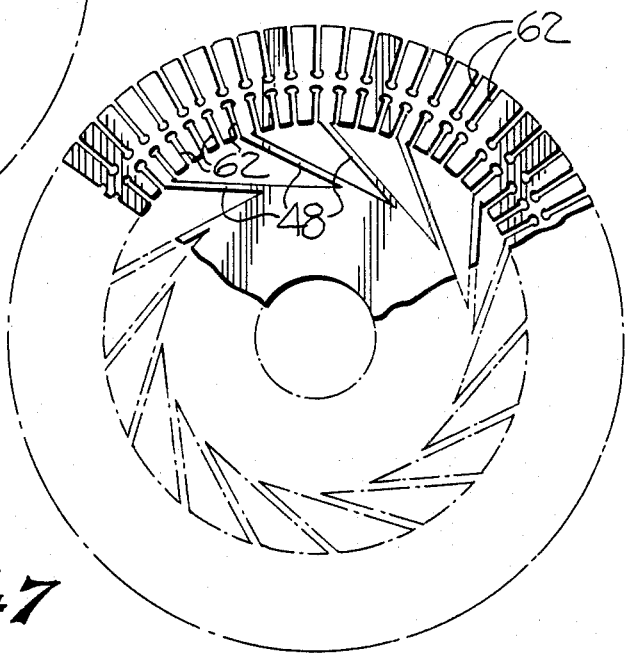

In the embodiment of FIG. 6, the radial slots 62 communicate with the outer circumference of the ring 25, and the inner circumference is continuous and free of such slots. FIG. 8 illustrates another embodiment wherein the radial slots 62 communicate only with the inner circumference of the ring. FIGS. 5 and 7 illustrate two further embodiments, wherein the slots extend from both the outer and the inner circumference of the ring. In FIG. 5, the slots in the outer circumference are staggered with respect to the slots in the inner circumference, and in FIG. 7, the slots are aligned.

In the embodiment of FIG. 22, the deflecting force is diminished by dividing the annular ring 25 into individual narrow rings 65, which are connected to each other by radial crosspieces 66. These rings 65 are defined by a plurality of arcuate slots which define a plurality of interrupted concentric circles, with the crosspieces 66 of adjacent circles being offset from each other. Typically, the individual rings are about 2 mm wide, and the gap between the rings is a fraction of a millimeter. These individual rings 65 of the annular ring 25 are readily displaceable with respect to each other in the axial direction, which means that the annular ring 25 as a whole may be readily deflected about a circular line which is positioned between the outer and inner diameters of the ring.

Figure 19:
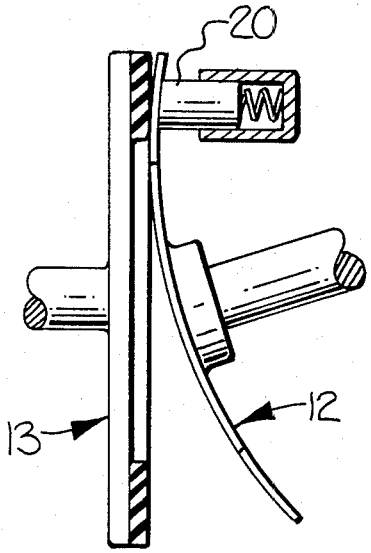
FIG. 19 is a sectional side elevation view wherein the entire disc is arcuately curved in cross section.

As shown in FIG. 14, the annular ring 25 of the disc has an arcuate shape in cross section, with its convex face pressed against the yarn and against the rigid supporting disc 13. The radius of the annular ring is sufficiently large so that a linear contact with the yarn is achieved. The deformability of the annular ring is increased by its arcuate shape. The entire disc 12 may also be designed with an arcuate curvature in cross section, note FIG. 19. In this embodiment, the friction coating of the annular ring may be flat, to insure a linear contact between the disc and the yarn. As to these embodiments, the axes of the discs 12 and 13 may be slightly inclined with respect to each other.

The annular rings 25 of all embodiments are preferably coated with a friction material which has an appropriately high friction coefficient with regard to the yarn. When manufacturing the annular ring according to the embodiments of FIGS. 1–8 and 22, this friction material may be vulcanized onto the annular ring such that the slots between the sections, or the individual rings of the ring, are at least partially filled, so that the back face of the ring presents a substantially smooth contact surface for engagement by the pressure applying member.

To further reduce friction between the pressure applying member and the rear face of the annular ring, the pressure applying member may be provided with static or dynamic air lubrication, of the type described in U.S. Pat. No. 4,339,915. It has also proven useful to place a thin plate 35 of a material having a low coefficient of friction on the back face of the disc 12 in the manner shown in FIGS. 4 and 23. The plate 35 should have a low coefficient of friction, and may be fabricted from Teflon or other suitable plastic.

Figure 23:
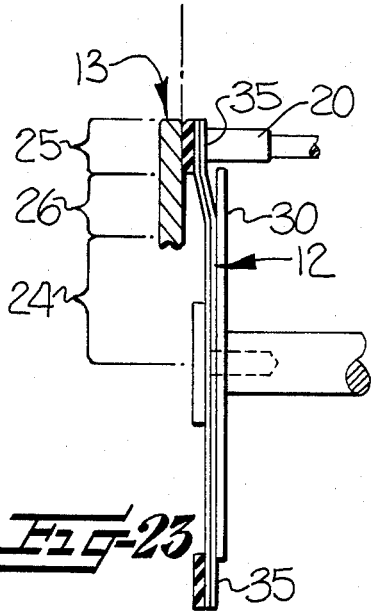
FIGS. 23 and 24 are sectional side elevation views illustrating various mounting means for the discs.
Figure 24:
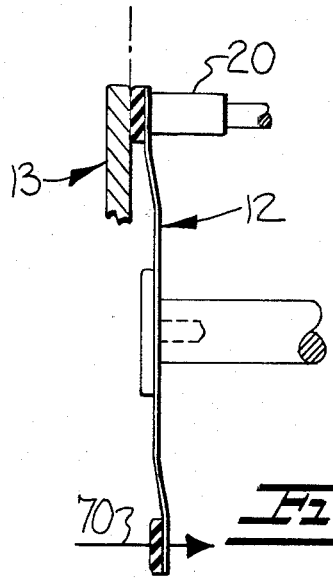

In many instances, the annular ring 25 cannot be deflected from its normal plane without a counter movement occuring on that side of the disc which is displaced by 180 degrees from its point of deflection. This counter movement is illustrated by arrow 70 in FIG. 24. As shown in FIG. 23, this counter movement is alleviated by the backup plate 30 which is placed on the back side of the flexible disc, and which is sufficiently rigid to resist the counter movement. In this embodiment, the diameter of the plate 30 exceeds the inner diameter of the annular ring 25 and as a result, the annular ring contacts the plate in the region of its counter movement. The extent of the deflection of the annular ring from its normal plane is confined to the region of the pressure applying member 20 at the twisting zone, which serves to improve the smoothness of the run of the disc.

Figure 20:
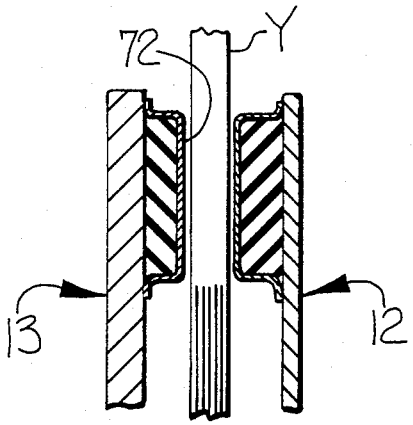
FIGS. 20 and 21 are fragmentary sectional views illustrating two types of friction coating on the annular discs.
Figure 21:
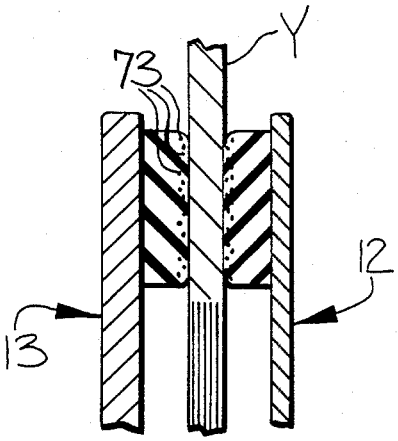

FIG. 20 illustrates an embodiment wherein the elastomeric friction coatings on the discs 12 and 13 are covered with a foil 72 having advantageous friction properties. In FIG. 21, the friction coatings consist of an elastomeric material having diamond or ceramic particles 73 or the like embedded therein.

Figure 25:
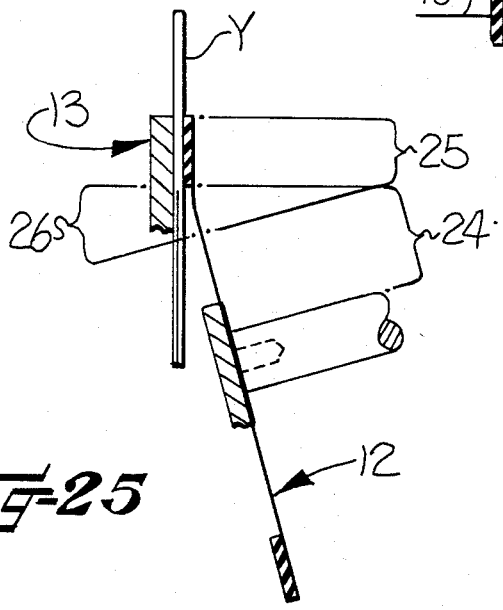
FIG. 25 is a sectional side elevation view of an embodiment wherein the flexible disc is deflected from its normal path of travel by contact with a cooperating rigid disc.

FIG. 25 illustrates an embodiment of the present invention wherein the flexible disc 12 is deflected from its normal plane of rotation by contact with the cooperating disc 13 at the twisting zone, and as further described in the above noted U.S. application Ser. No. 272,936.

In the drawings and specification, there has been set forth a preferred embodiment of the invention, and although specific terms are employed, they are used in a generic and descriptive sense only and not for purposes of limitation.

That which is claimed is:

1. A circular disc adapted for use in a yarn false twisting apparatus of the like and which is characterized by the ability to be rotated at a relatively high speed and be laterally flexed into firm engagement with a running yarn or the like by a relatively small lateral biasing force, said disc comprising a sheet of thin springy material and which includes a hub portion disposed adjacent the center of the disc, an annular ring disposed concentrically about said hub portion and including a yarn engaging friction surface on one face thereof, and distinct junction means joining said hub portion and said annular ring, with said junction means being substantially weaker than the remaining portions of said sheet, and such that the annular ring is adapted to readily flex in the lateral direction with respect to said hub portion and a rotating torque may be transmitted to the annular ring without significant circumferential deformation.

2. The disc as defined in claim 1 wherein said disc is composed of an integral sheet of material, and wherein said junction means is defined by openings extending through said sheet.

3. The disc as defined in claim 2 wherein said openings through said sheet define a plurality of spokes extending radially between said hub portion and said annular ring.

4. The disc as defined in claim 2 wherein said openings through said sheet define a plurality of spokes extending between said hub portion and said annular ring in a direction substantially tangent to said hub portion.

5. The disc as defined in claim 2 wherein said openings through said sheet define a plurality of spokes extending between said hub portion and said annular ring, with said spokes including a pair of radial segments interconnected by an intermediate arcuate segment which is concentric to the center of said disc.

6. The disc as defined in claim 2 wherein said openings through said sheet define a plurality of interrupted circles which are concentric to the center of the disc and have different diameters.

7. The disc as defined in claim 6 wherein said interrupted circles define crosspieces at the interruptions, and wherein the crosspieces of one circle are circumferentially offset from the crosspieces of each adjacent circle.

8. The disc as defined in claim 7 wherein the openings of each circle include two segments which each extend for slightly less than 180 degrees, to thereby define a pair of crosspieces on each circle, and wherein the crosspieces of adjacent circles are offset by 90 degrees.

9. The disc as defined in claim 2 wherein the openings through said sheet material define a plurality of tongues extending in the circumferential direction, with one end of each tongue being joined to said hub portion and the other end of each tongue being joined to said annular ring.

10. The disc as defined in claim 1 wherein said annular ring includes an elastomeric material defining said friction surface.

11. The disc as defined in claim 1 wherein said ring is divided by a plurality of evenly spaced radial slots extending through a portion of the radial dimension thereof.

12. The disc as defined in claim 11 wherein said radial slots communicate with the outer circumference of said ring, and with the inner circumference being continuous and free of such slots.

13. The disc as defined in claim 11 wherein said radial slots communicate with the inner circumference of said ring, and with the outer circumference being continuous and free of such slots.

14. The disc as defined in claim 11 wherein said radial slots communicate with both the outer circumference of said annular ring and the inner circumference thereof, with the slots on the outer circumference being radially aligned with the slots on the inner circumference, and so as to define a continuous circumferential band adjacent the medial portion of the ring.

15. The disc as defined in claim 11 wherein said radial slots communicate with both the outer circumference of said annular ring and the inner circumference thereof, with the slots on the outer circumference being circumferentially offset from the slots on the inner circumference, and so as to define a continuous circumferential band adjacent the medial portion of the ring.

16. The disc as defined in claim 1 wherein said ring includes a plurality of arcuate slots which define a plurality of interrupted concentric circles.

17. A circular disc adapted for use in a yarn false twisting apparatus or the like and which is characterized by the ability to be rotated at a relatively high speed and be laterally flexed into firm engagement with a running yarn or the like by a relatively small lateral biasing force, said disc comprising an integral sheet of thin springy metallic material having a thickness of between about 0.1 to 0.5 mm, and including a hub portion disposed adjacent the center of the disc, an annular ring disposed concentrically about said hub portion and including a plurality of slots extending therethrough to render the same highly flexible, and distinct and highly flexible junction means joining said hub portion and said annular ring, with said junction means being substantially weaker than the remaining portions of said sheet, and such that the annular ring is adapted to readily flex in the lateral direction with respect to said hub portion and a rotating torque may be transmitted to the annular ring without significant circumferential deformation, and wherein said junction means is defined by openings extending through said sheet of material.

18. The disc as defined in claim 17 wherein said annular ring includes a plurality of slots extending therethrough to render the same highly flexible.

19. The disc as defined in claim 18 further comprising an elastomeric material bonded to said sheet of material so as to overlie at least one face of said annular ring to define a yarn engaging friction surface.

20. The disc as defined in claim 19 wherein said elastomeric material overlies said slots of said annular ring and said openings of said junction means.

21. The disc as defined in claim 19 wherein said elastomeric material which overlies said annular ring includes particulate matter embedded therein.

22. The disc as defined in claim 19 wherein said elastomeric material which overlies said annular ring is composed of a relatively soft material having a coating of a low friction material.

23. A circular disc adapted for use in a yarn false twisting apparatus or the like and which is characterized by the ability to be rotated at a relatively high speed and be laterally flexed into firm engagement with a running yarn or the like by a relatively small lateral biasing force, said disc comprising a pair of relatively thin and flexible circular plates which are spaced apart and aligned with respect to each other in the lateral direction, with said plates being interconnected to each other along their outer circumferences and along the circumference of a concentric circle disposed adjacent the center of the plates, and with the remaining portion of said plates being free of such interconnection.

24. In a yarn false twisting apparatus comprising a pair of twist imparting members, with each member including a yarn engaging friction surface, and at least one of said members comprising a relatively thin and flexible circular disc, means rotatably mounting said members such that portions of the respective yarn engaging friction surfaces are disposed in opposing, face to face relationship and define a twisting zone therebetween, and such that a force is applied to effect biasing of said twist imparting members toward each other at said twisting zone, and drive means for operatively rotating each of said members about their respective axes, and such that a yarn may be continuously moved through said twisting zone while having twist imparted thereto by frictional contact between the yarn and opposed friction surfaces, the improvement wherein said disc comprises a sheet of thin springy material and which includes a hub portion disposed adjacent the center of the disc, an annular ring disposed concentrically about said hub portion and including said yarn engaging friction surface on one face thereof, and distinct and highly flexible junction means joining said hub portion and said annular ring with said junction means being substantially weaker than the remaining portions of said sheet, and such that the annular ring is adapted to readily flex in the lateral direction by said biasing force and a rotating torque may be transmitted to said annular ring without significant circumferential deformation.

25. The yarn false twisting apparatus as defined in claim 24 wherein said disc is composed of an integral, relatively thin sheet of metallic material, and said yarn engaging friction surface of said disc comprises an elastomeric material bonded to one face of said annular ring.

26. The yarn false twisting apparatus as defined in claim 24 or 25 wherein said junction means is defined by openings extending through said sheet, and said annular ring includes a plurality of slots extending therethrough to render the same highly flexible.

27. The yarn false twisting apparatus as defined in claim 24, the improvement further comprising yarn guide means for guiding a moving yarn through said twisting zone, and wherein said means rotatably mounting said members includes biasing means positioned to apply a force to the face of said disc opposite its yarn engaging friction surface.

28. The yarn false twisting apparatus as defined in claim 27 wherein said biasing means is positioned so as to apply said force at a location which is centered between about 1 to 5 mm in front of the centerline of the yarn path of travel when viewed in the direction of rotation of said disc.

29. The yarn false twisting apparatus as defined in claim 27 further comprising a sheet of a material having a relatively low friction coefficient overlying the side of said annular ring opposite said yarn engaging friction surface, for minimizing the friction between said disc and said biasing means.

30. The yarn false twisting apparatus as defined in claim 24 wherein said means mounting said flexible disc includes a rigid supporting circular plate positioned on the side of said disc opposite said yarn engaging friction surface, with the radius of said supporting plate being greater than that of said hub portion.

31. The yarn false twisting apparatus as defined in claim 30 wherein the radius of said supporting plate is greater than the inside radius of said annular ring but less than the distance between the center of said disc and the location of the twisting zone.

32. A circular disc adapted for use in a yarn false twisting apparatus or the like, and which comprises an elastomeric material defining an annular yarn engaging friction surface on one face thereof, and reinforcing means comprising a relatively thin springy sheet of material intimately engaging said elastomeric material and disposed in a plane parallel to the friction surface for absorbing centrifugal forces which are operative on the disc, said sheet of material including a hub portion disposed adjacent the center of the disc, an annular ring portion disposed adjacent said annular yarn engaging friction surface, and distinct junction means joining said hub portion and said annular ring portion, with said junction means being substantially weaker than the remaining portions of said sheet; and said disc being sufficiently thin so as to be readily flexible in the lateral direction and so as to permit said annular ring portion to be laterally biased into firm engagement with a running yarn or the like and while said disc is rotating at a relatively high speed.

33. The disc as defined in claim 32 wherein said junction means is defined by a plurality of openings extending through said sheet.

* * * * *